US006254357B1

(12) United States Patent
Lynn et al.

(10) Patent No.: US 6,254,357 B1
(45) **Date of Patent: *Jul. 3, 2001**

(54) FLUID PUMPING APPARATUS

(75) Inventors: William H. Lynn, Kohler; Paul J. Thomas, Sheboygan Falls, both of WI (US)

(73) Assignee: Thomas Industries Inc., Sheboygan, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/593,639

(22) Filed: Jun. 13, 2000

Related U.S. Application Data

(63) Continuation of application No. 09/007,605, filed as application No. PCT/US96/12362 on Jul. 24, 1996, now Pat. No. 6,074,174, which is a continuation-in-part of application No. 08/506,491, filed on Jul. 25, 1995, now Pat. No. 5,593,291.

(51) Int. Cl.[7] ..... F04B 1/12
(52) U.S. Cl. ..... 417/269; 417/539
(58) Field of Search ..... 417/269, 271, 417/419, 539; 91/500, 501; 92/171

(56) References Cited

U.S. PATENT DOCUMENTS

| | | | |
|---|---|---|---|
| 862,867 | 8/1907 | Eggleston | 417/472 |
| 3,961,868 | 6/1976 | Droege, Sr. et al. | 417/550 |
| 4,028,015 | 6/1977 | Hetzel | 417/415 |
| 4,138,203 | 2/1979 | Slack | 417/269 |
| 4,231,713 | 11/1980 | Widdowson et al. | 417/222 |
| 4,235,116 | 11/1980 | Meijer et al. | 74/60 |
| 4,396,357 | 8/1983 | Hartley | 417/269 |
| 4,507,058 | 3/1985 | Schoenmeyr | 417/271 X |
| 4,610,605 | 9/1986 | Hartley | 417/269 |
| 4,776,257 | 10/1988 | Hansen | 92/122 |
| 4,801,249 | 1/1989 | Kakizawa | 417/269 |
| 4,995,795 | 2/1991 | Hetzel et al. | 417/571 |
| 5,006,047 | 4/1991 | O'Connell | 417/238 |
| 5,070,765 | 12/1991 | Parsons | 417/269 |
| 5,147,190 | 9/1992 | Hovarter | 417/571 |
| 5,167,181 | 12/1992 | Lee | 91/499 |
| 5,362,208 | 11/1994 | Inagaki et al. | 417/269 |
| 5,593,291 | 1/1997 | Lynn | 417/539 |

FOREIGN PATENT DOCUMENTS

4411383A1 11/1994 (GB) .

*Primary Examiner*—Henry C. Yuen
*Assistant Examiner*—Mahmond Gimie
(74) *Attorney, Agent, or Firm*—Quarles & Brady LLP

(57) ABSTRACT

An axial piston fluid pumping apparatus is disclosed in which wobble pistons are rigidly connected to arms of a nutating plate that is rotatably mounted on a bearing which is mounted on a drive shaft. The axis of the bearing is at an acute angle to the axis of the shaft. The wobble pistons move within cylinders whose bores are disposed about the axis of the shaft. The motion of the pistons is in three dimensions within the bores.

11 Claims, 9 Drawing Sheets

FIG. 1
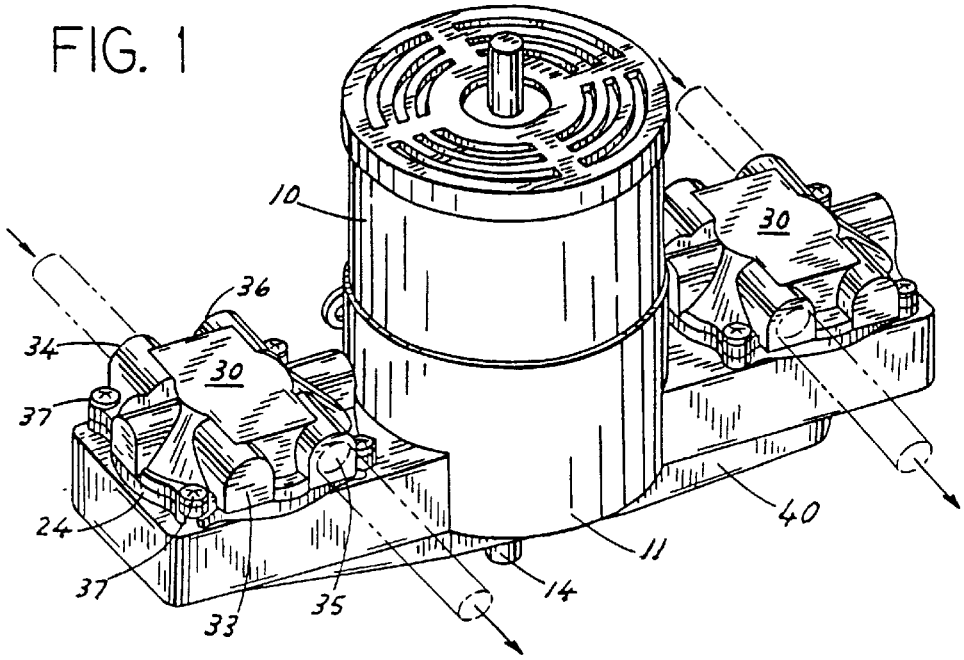
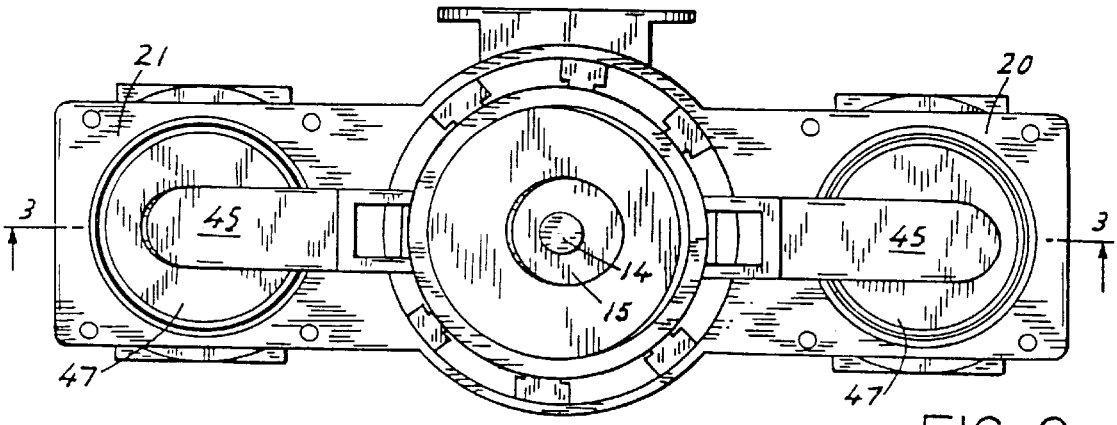
FIG. 2
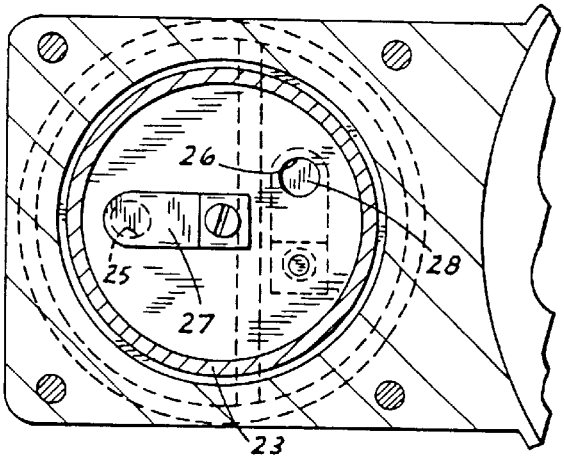
FIG. 5

10
11
12
13
14
15
20
21
22
23
24
25
27
28
30
31
32
40
41
43
44
45
46
47
52
5
6

22
23
47
48
49
50
51

FIG. 4
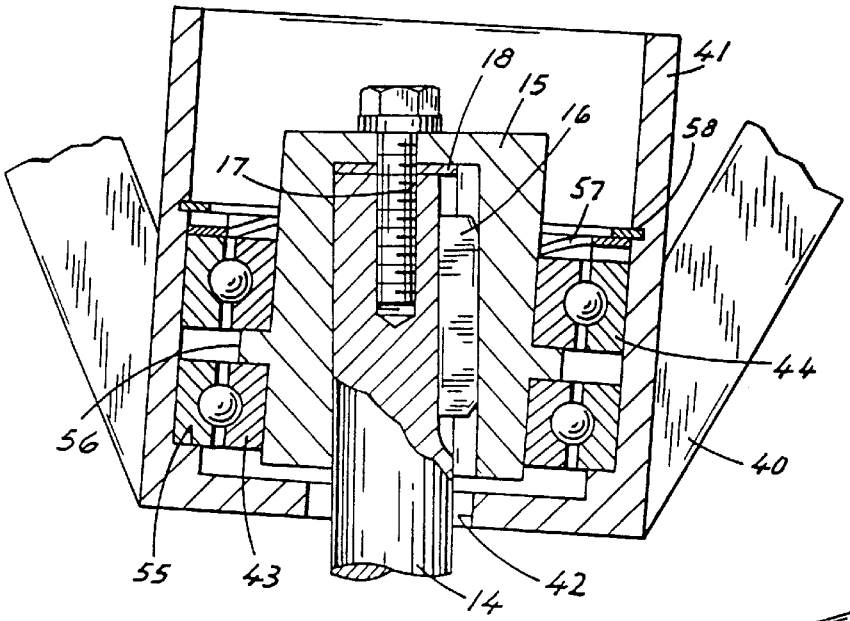
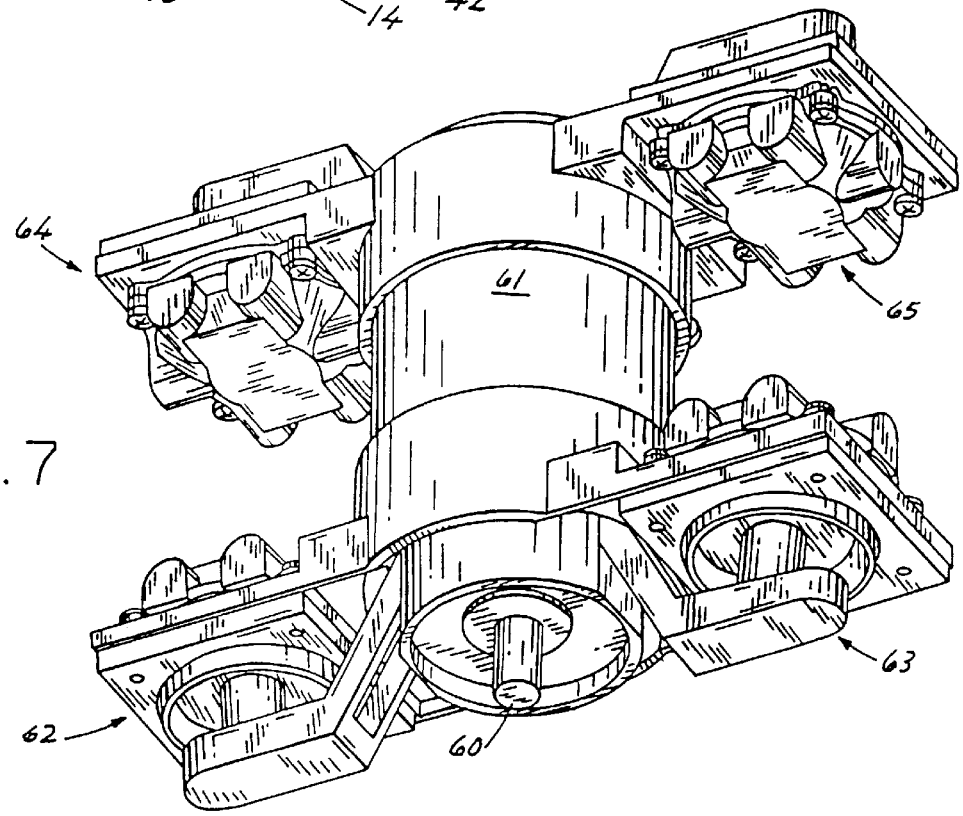
FIG. 7

FIG. 11
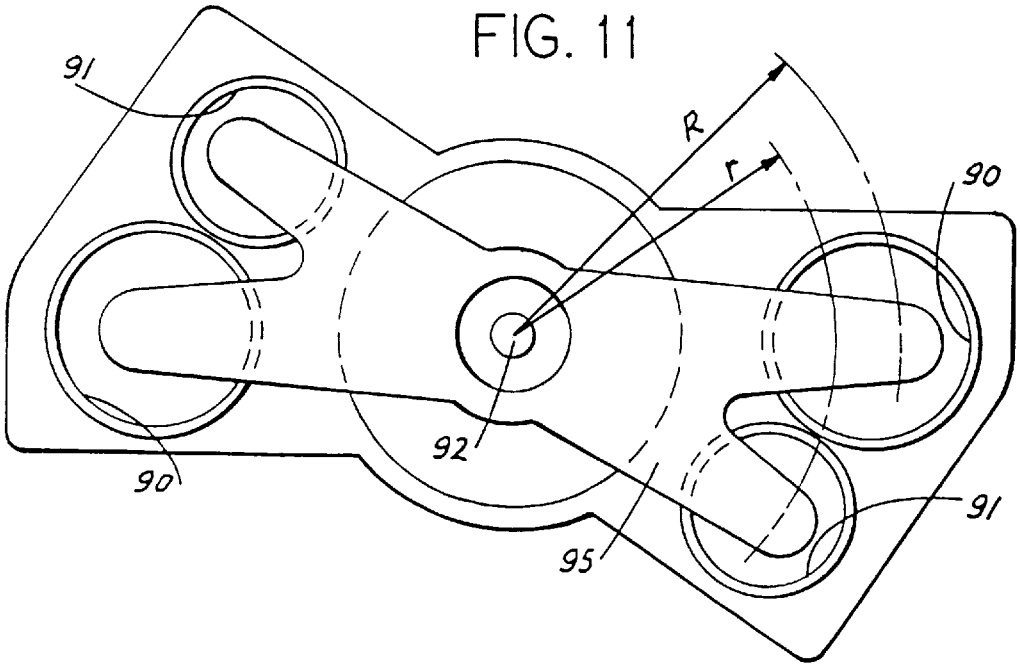
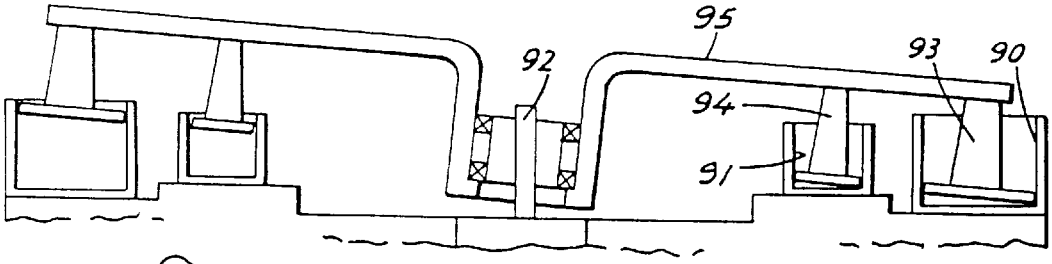
FIG. 12
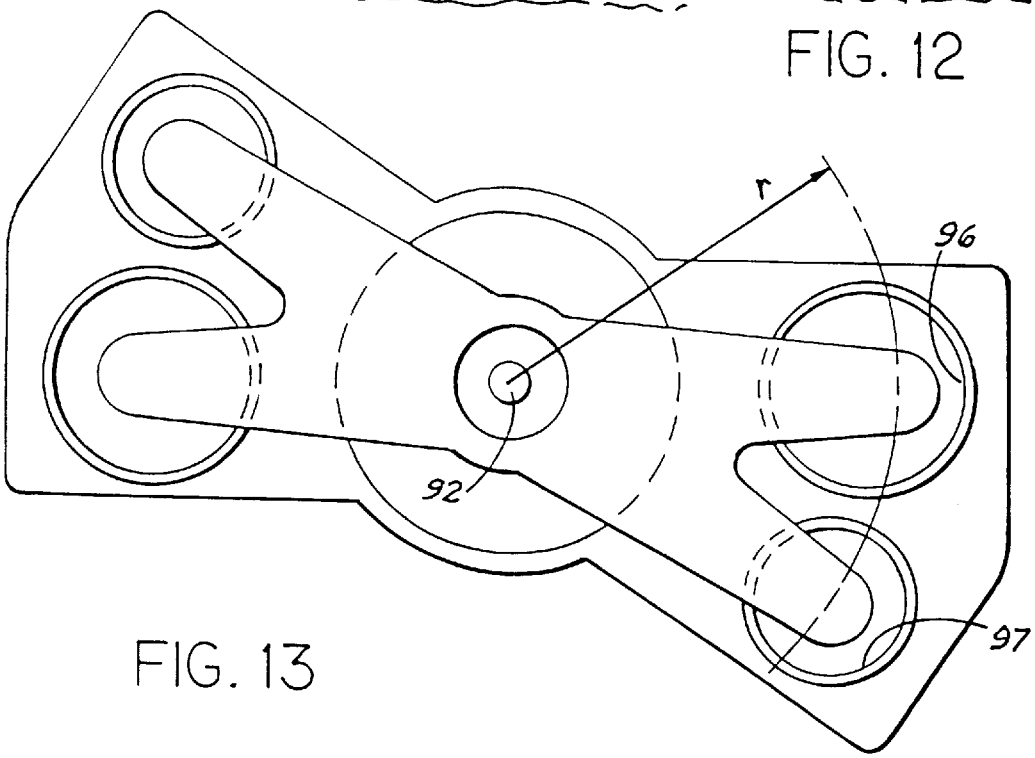
FIG. 13

FLUID PUMPING APPARATUS

This application is a continuation of U.S. application Ser. No. 09/007,605 filed Jan. 15, 1998, now U.S. Pat. No. 6,074,174 which is a continuation of International Application No. PCT/US96/12362 filed Jul. 24, 1996, which is a continuation-in-part of U.S. application Ser. No. 08/506,491 filed Jul. 25, 1995, now U.S. Pat. No. 5,593,291.

BACKGROUND OF THE INVENTION

This invention relates to an axial piston fluid pumping apparatus, and more particularly to such an apparatus which uses a wobble piston, the stroke for which is provided by a nutating plate.

Two known types of compressors are the wobble piston type and the swashplate type. The wobble piston type is exemplified by U.S. Pat. No. 3,961,868 issued Jun. 8, 1976, to Droege, Sr., et al. for "Air Compressor". Such a compressor uses a piston whose head has a peripheral seal that seals with a cylinder bore. The piston rod is mounted radially on a crankshaft. The piston includes no joints or swivels. As a result, the piston head is forced to "wobble" in two dimensions within the cylinder bore as it is driven by the crankshaft.

The swashplate type compressor uses a plurality of axial cylinders arranged in a circle about a drive shaft. A swashplate is inclined relative to the shaft axis such that the plate gyrates as the drive shaft is rotated. Pistons are mounted in each of the cylinders. The ends of the piston rods are connected to elements that slide over the surface of the swashplate as the swashplate rotates. The result is that the centerline of the piston head is moved solely in an axial direction as the pistons are stroked within the cylinders. An example of such an axial piston swashplate compressor is found in U.S. Pat. No. 5,362,208 issued Nov. 8, 1994 to Inagaki, et al. for "Swashplate Type Compressor". Another example is U.S. Pat. No. 4,776,257 issued Oct. 11, 1988, to Hansen for "Axial Pump Engine". In the Hansen patent, the centerline of the piston heads are inclined relative to the centerline of the cylinder bore, but the piston heads are moved only along the piston head centerline in one direction.

The present invention combines the wobble pistons normally used in radial piston pumps with a nutating plate rather than the swashplate normally used in axial piston pumps. The result is a simple and effective fluid pumping apparatus.

SUMMARY OF THE INVENTION

In accordance with the invention, a fluid pumping apparatus includes a drive shaft and a cylinder having a bore. Fluid inlet and outlet valves communicate with the cylinder bore. A bearing is mounted on the shaft with the centerline of the bearing at an angle to the shaft axis. An arm is mounted on the bearing. A wobble piston is rigidly attached to the arm and is disposed in the cylinder bore. As the drive shaft rotates, the centerline of the bearing will precess about the shaft axis, and the arm will be moved, thereby causing the wobble piston to move in three dimensions within the cylinder bore.

Further in accordance with the invention, the bearing is mounted on a hub that is secured to the shaft with the axis of the hub at an acute angle to the shaft axis.

Preferably, two or more cylinders are arranged symmetrically about the shaft axis with a wobble piston in each cylinder bore.

The centerline of the cylinder bore may be parallel with the shaft axis, or may be parallel with the bearing centerline, or may be formed as an arc of a circle whose center is at the intersection of the bearing centerline and the shaft axis.

In another preferred embodiment, the drive shaft is a through-shaft of an electric motor. Two or more cylinders are spaced about each end of the through-shaft. A nutating plate containing two or more arms is mounted about a bearing on each end of the through-shaft. Wobble pistons are rigidly attached to each arm and disposed in a respective cylinder. Preferably, the cylinder bores on one end of the through-shaft are axially aligned with the cylinder bores on the other end, and the pistons in aligned cylinder bores move opposite to each other.

The inlet and outlet valves may be formed in separate valve plates associated with each cylinder. Alternately, the inlet valve may be formed in the piston which may be provided with a central passage leading to the exterior. A filter may be inserted in the passage to prevent contamination of the cylinder.

In a further embodiment, plural cylinders are formed in a common cylinder sleeve with a single valve plate containing inlet and outlet valves for each of the cylinders. The valve plate and cylinder sleeve stacks with a head member that contains inlet and exhaust chambers that are shared by all cylinders. The stacked cylinder sleeve, valve plate and head may be connected to a motor housing at one end and to a fan housing on the other end, with a motor shaft extending through the stack to mount the hub that supports a carrier for the wobble pistons and which also mounts a fan.

The plurality of cylinder bores may be of identical size or the bores may be of different diameters arranged either at the same distance or different distances from the shaft axis.

The face of the valve plate that confronts the piston head is preferably inclined to be nearly parallel with the surface of the piston head when the piston is at top dead center.

It is a principal object of the invention to provide a simplified axial piston pumping apparatus using wobble pistons.

It is another object of the invention to provide an axial piston pump which does not require the use of sliding elements requiring continuous lubrication.

The foregoing and other objects and advantages of the invention will be apparent from the following detailed description. In the description, reference is made to the drawings which illustrate preferred embodiments of the invention.

BRIEF DESCRIPTION OF THE DRAWINGS

FIG. 1 is a view in perspective of a first embodiment of the invention utilizing a pair of cylinders and wobble pistons;

FIG. 2 is an end view of the apparatus of FIG. 1;

FIG. 4 is an enlarged view in section showing the preferred hub and bearings assembly;

FIG. 5 is a plan view of a valve plate taken in the plane of the line 5—5 of FIG. 3;

FIG. 7 is a view in perspective of a second embodiment of the invention utilizing two pairs of cylinders and wobble pistons;

FIG. 11 is a plan view of another embodiment in which cylinder bores of difference diameters are arranged at different distances from the shaft axis;

FIG. 12 is a schematic side view, partially in section, of the embodiment of FIG. 11;

FIG. 13 is a plan view of a further embodiment in which cylinder bores of different diameters are arranged at the same distance from the shaft axis;

DETAILED DESCRIPTION OF THE PREFERRED EMBODIMENTS

Figure 3:
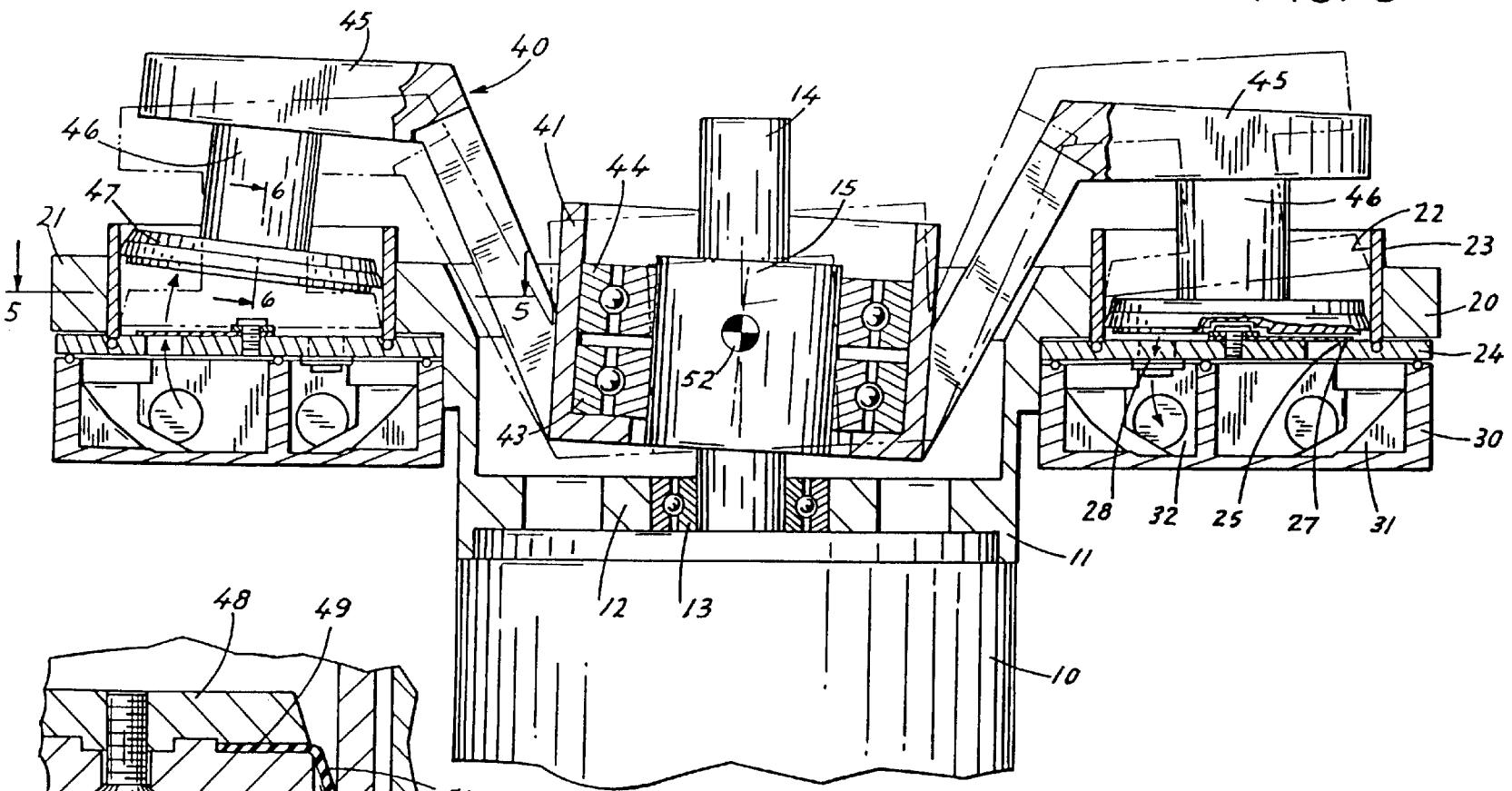
FIG. 3 is a view in section taken in the plane of the line 3—3 of FIG. 2.
Figure 6:
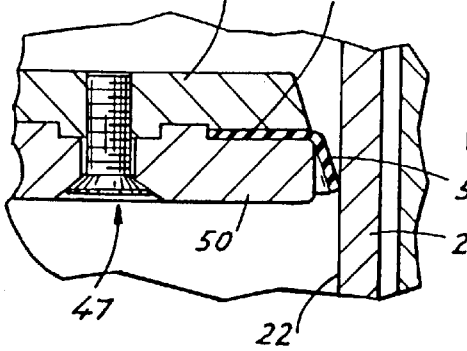
FIG. 6 is an enlarged view in section through a piston head and taken in the plane of the line 6—6 of FIG. 3.

Although the invention can be adapted for pumping, a wide variety of fluids, it is particularly useful in an air compressor or vacuum pump. Referring to FIGS. 1 through 6, an electric motor 10 is rabbeted to a housing 11. The housing includes a support plate 12 which mounts a bearing 13 for a motor drive shaft 14. A hub 15 is connected to the shaft 14 by means of a key 16, as shown in FIG. 4. The hub 15 is locked axially on the drive shaft 14 by means of a bolt 17 that is threaded into an axial bore in the end of the drive shaft 14. A shim washer 18 is disposed between the head of the bolt 17 and the hub 15 to allow for adjustment of the axial clearance between the shaft 14 and hub 15. As is apparent from FIGS. 3 and 4, the centerline or axis of the hub 15 is at an acute angle to the axis of the shaft 14.

The housing 11 mounts a pair of axial cylinders 20 and 21 having cylinder bores 22 each defined by a cylinder sleeve 23. The centerlines of the cylinder bores 22 are parallel to the axis of the drive shaft 14. A valve plate 24 closes off the top of each cylinder 20 and 21. Each valve plate 24 includes an inlet valve opening 25 and an outlet valve opening 26. The valve openings 25 and 26 are normally closed by an inlet flapper 27 and an exhaust flapper valve 28, respectively. A cylinder head 30 is mounted on each valve plate 24. The cylinder heads 30 each include an inlet chamber 31 and an exhaust chamber 32. The heads 30 have inlet or outlet connection points 33 and 34 leading to the inlet chamber 31 and similar connection points 35 and 36 leading to the exhaust chamber 32. As will be explained further hereafter, the inlet and exhaust chambers 31 and 32 can be connected in a variety of ways through the connection points 33 through 36 to external piping.

The heads 30 and valve plates 24 are joined to the cylinders 20 and 21 by bolts 37. Suitable O-rings seal the mating surfaces of the head 30 with the valve plate 24 and of the cylinder sleeve 22 with the valve plate 24. The construction of the valve plates 24, heads 30, and cylinder sleeves 22 is similar to that which is illustrated and described in U.S. Pat. No. 4,995,795 issued Feb. 26, 1991, to Hetzel, et al., and assigned to the assignee of this application. The disclosure of the Hetzel, et al. '795 patent is hereby incorporated by reference as though fully set forth herein.

A nutating plate 40 has a central cup 41 with an enlarged rear opening 42 that receives the drive shaft 14. A pair of deep-grooved ball bearings 43 and 44 have their inner races mounted about the hub 15 and their outer races mounted within the cup portion 41 of the plate 40. The plate 40 has a pair of arms 45 extending laterally in opposite directions from the cup portion 41. Each of the arms 45 rigidly mounts a wobble piston 46 having its piston head 47 disposed in the bore of one of the cylinders 20 and 21. The piston heads 47 are of known construction. Briefly, they include a main piston portion 48 which mounts a seal 49 that is clamped to the main portion 48 by a clamp plate 50. The seal 49 has a peripheral flange 51 which seals with the cylinder bore 22. The seal 49 is preferably made of Teflon or other similar material that does not require lubrication. The details of the construction of the piston head are shown in U.S. Pat. No. 5,006,047 issued Apr. 9, 1991, to O'Connell and assigned to the assignee of this invention. The disclosure of the O'Connell '047 patent is hereby incorporated by reference as though fully set forth herein.

As the drive shaft 14 is rotated by the motor 10, the centerline or axis of the hub 15 will precess in a conical path about the axis of the shaft 14. The movement of the hub 15 is translated into three dimensional movement of the piston heads 47 within the cylinder bores 22. The ends of the arms 45 will move through one arc in the plane of the section of FIG. 3. The ends of the arms 45 will also move through a much smaller arc in a plane that is normal to the plane of the section of FIG. 3.

For best operation, the center of gravity 52 of the assembly of the plate 40 and the wobble pistons 46 is located at or near the intersection of the axes of the hub 15 and the drive shaft 14. This will ensure the smoothest, quietest operation with the least vibration.

The preferred assembly of the hub 15, bearings 43 and 44, and cup 41 is shown in FIG. 4. The outer race of one of the bearings 43 is disposed against a ledge 55 in the cup 41. The inner races of the bearings 43 and 44 are disposed against a flange 56 extending from the hub 15. Finally, the outer race of the second bearing 44 abuts a wavy washer 57 held in place by a snap ring 58.

The fluid pumping apparatus does not involve sliding surfaces that must be lubricated, as is typical in axial piston swashplate type compressors. The only sliding action is that of the seal 49 of the wobble pistons on the cylinder bores 22. The seals 49 have proven to be capable of such motion without the need for lubrication.

The apparatus can be used either as a compressor or a pump depending upon what devices are connected to the inlet and exhaust chambers. The apparatus of FIGS. 1–6 is arranged to operate as a compressor. To function as a pump, it is preferable to mount the seals 49 in a manner such that their peripheral flanges 51 extend away from the bottom of the cylinder. This is the reverse of that shown in FIGS. 1–6.

Although the first embodiment uses a pair of symmetrically arranged cylinders, any number of cylinders with corresponding numbers of wobble pistons may also be used. The cylinders should be arranged symmetrically about the shaft axis. Furthermore, the invention is also useful with only a single cylinder with a single arm mounting a wobble piston disposed in the single cylinder.

In the embodiment of FIG. 7, a pair of cylinders with wobble pistons are mounted on each end of a through-shaft 60 of a motor 61. In the arrangement of FIG. 7, the assembly of hubs, bearings, cylinders, valve plates, heads, and nutating plates, as described with respect to FIGS. 1 through 6, is duplicated on each end of the through-shaft 60 of the motor 61. The cylinder assemblies 62 and 63 on one end of the through-shaft 60 are aligned with the cylinder assemblies 64 and 65 on the other end of the through-shaft 60. To best balance the dynamic forces, the pistons operating in each pair of aligned cylinders 62, 64, and 63, 65 move in opposite directions to each other.

The fluid pumping apparatus of this invention may be used as a compressor or a vacuum pump. It may be plumbed in a variety of manners. For example, the embodiment of FIGS. 1–6 may have each of the cylinders separately plumbed so that each acts as an independent pumping device, either as a compressor or a vacuum pump. As an alternative, the exhaust chamber 32 of one of the two cylinders may be connected to the inlet chamber 31 of the other of the two cylinders so that a two-stage pressure or vacuum operation is achieved.

Figure 8A:
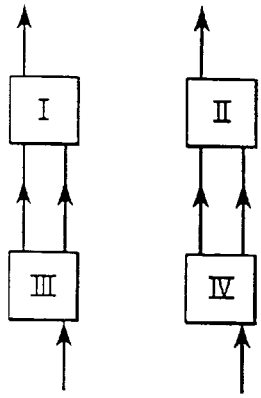
FIGS. 8*a* through 8*d* are schematic representations of alternative arrangements for connecting the cylinders in the embodiment of FIG. 7.
Figure 8B:
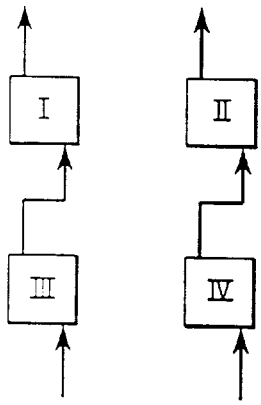

The four-cylinder arrangement of the embodiment of FIG. 7 affords even greater alternatives for interconnection. Some of the possible alternatives are illustrated in FIGS. 8*a* through 8*d* in which the four cylinders are identified by I through IV. In FIG. 8*a,* a compressor or pump arrangement is shown in which the inlet chambers of cylinders III and I are connected in parallel, and the outlet chambers of cylinders III and I are similarly connected in parallel. The result is that cylinders I and III function as two separate compressors or two separate pumps. The cylinders IV and II may be similarly plumbed in parallel so that they can function as two separate compressors or two separate pumps. In the arrangement of FIG. 8*a,* the cylinders I and III can function as compressors while the cylinders II and IV can function as pumps, or vice versa. In the arrangement illustrated in FIG. 8*b,* the pair of cylinders I and III are connected in series. That is, the exhaust chamber of cylinder III is connected to the inlet chamber of cylinder I. The result is that there is a two-stage compression or pumping. In FIG. 8*b,* the cylinders II and IV are similarly connected in series, but they could also be connected in parallel as in FIG. 8*a.*

Figure 8C:
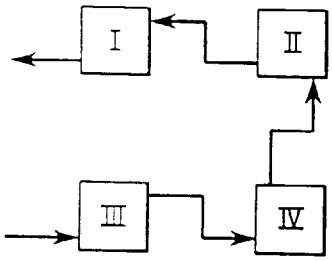
Figure 8D:
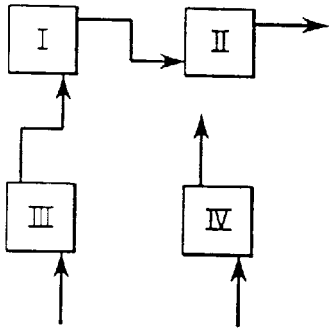

FIG. 8*c* illustrates an arrangement in which all four of the cylinders I through IV are connected in series so that there is a four-stage pumping or compression action. In FIG. 8*d,* three of the cylinder heads I, II, and III are connected in series while the fourth operates separately. Persons of ordinary skill in the art will appreciate many additional arrangements of plumbing that could be used.

Figure 9:
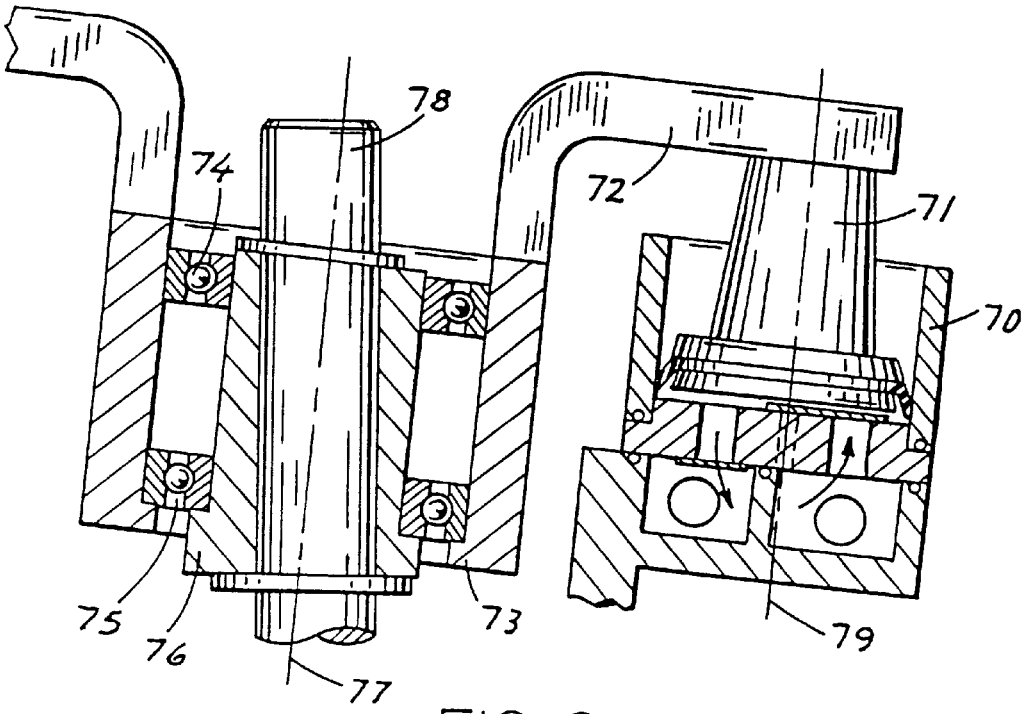
FIG. 9 is a partial view in section similar to FIG. 3 but showing an alternative embodiment in which the centerlines of the cylinder bores are parallel to the centerline of the bearing.
Figure 10:
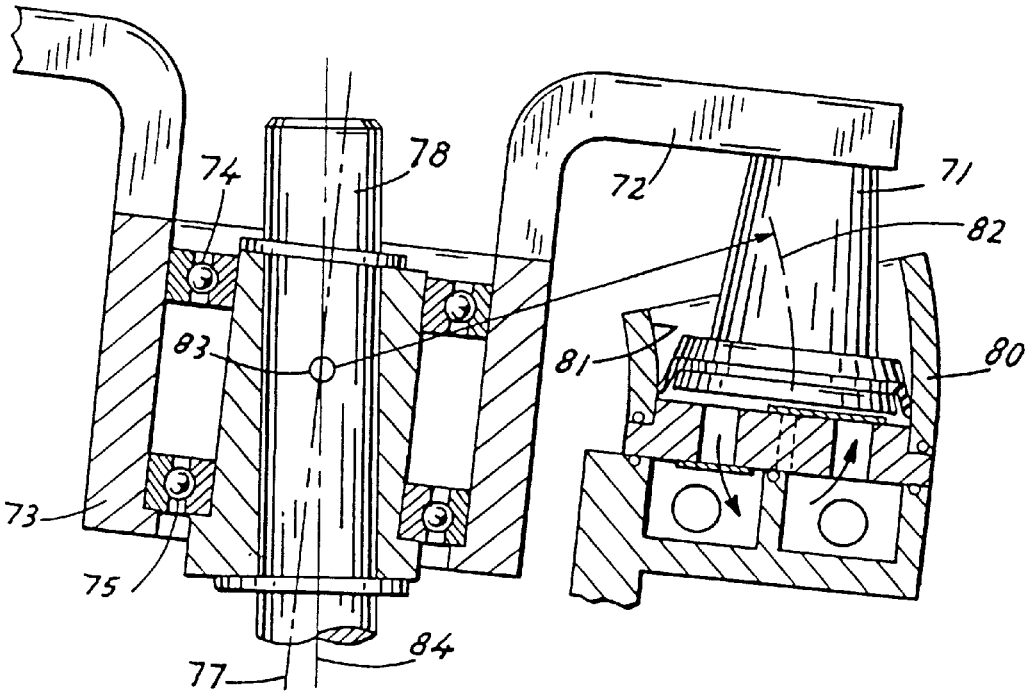
FIG. 10 is a partial view in section similar to FIG. 3 but showing, an alternative embodiment in which the centerlines of the cylinder bores are formed as an arc of a circle whose center is at the intersection of the shaft axis and the bearing centerline.

In the embodiments described thus far, the centerlines of the cylinder bores are parallel to the axis of the motor shaft. FIGS. 9 and 10 show two alternatives to that arrangement. In FIG. 9, a cylinder 70 receives a wobble piston 71 rigidly attached to an arm 72 extending from a nutating plate 73. The plate 73 is mounted on bearings 74 and 75 disposed about a hub 76. As in the previous embodiments, the hub 76 has its centerline 77 disposed at an acute angle to the axis of a shaft 78. In the embodiment of FIG. 9, the centerline 79 of the bore of the cylinder 70 is parallel to the centerline 77 of the hub 76. The plate 73 could mount several arms 72 with wobble pistons 71 disposed in several cylinders 70.

In FIG. 10, a cylinder 80 is formed with a cylinder bore 81 the centerline 82 of which is disposed along an arc of a circle whose center 83 is at the intersection of the hub axis 77 and the shaft axis 84.

In the embodiments described thus far, the cylinder bores have been of identical size and have been located at the same distance from the motor shaft. FIGS. 11 and 12 illustrate an arrangement in which the cylinder bores are of different diameters and are arranged at different distances from the motor shaft. Specifically, two sets of cylinder bores 90 and 91 are arranged symmetrically with respect to the motor shaft 92. The cylinder bores 90 of the first set are larger in diameter than the bores 91 of the second set. Correspondingly larger wobble pistons 93 operate in the larger bores 90 with smaller wobble pistons 94 operating in the smaller bores 91. The larger wobble pistons 93 are mounted on arms of a plate 95 at a distance R from the axis of the shaft 92. The smaller wobble pistons 94 are mounted on the plate 95 at a smaller distance r from the axis of the shaft 92. As a result of the arrangement of FIG. 11, the stroke of the larger pistons 93 will be longer than that of the smaller pistons 94 due to the shorter distance from the motor shaft 92.

FIG. 13 illustrates a further embodiment in which two sets of cylinder bores 96 and 97 are of different sizes but are arranged at the same radial distance r from the centerline of the shaft 92.

By selecting the combinations of bore size and piston stroke, the same or different pressures can be achieved in each of the cylinders. Larger bores with a shorter piston stroke can achieve low pressure but high flow. At the same time, smaller bores with a longer piston stroke can achieve high pressure operation but at a lower flow. The cylinders can be staged by having the exhaust of a high flow, lower pressure cylinder plumbed to the inlet of a higher pressure cylinder.

Figure 14:
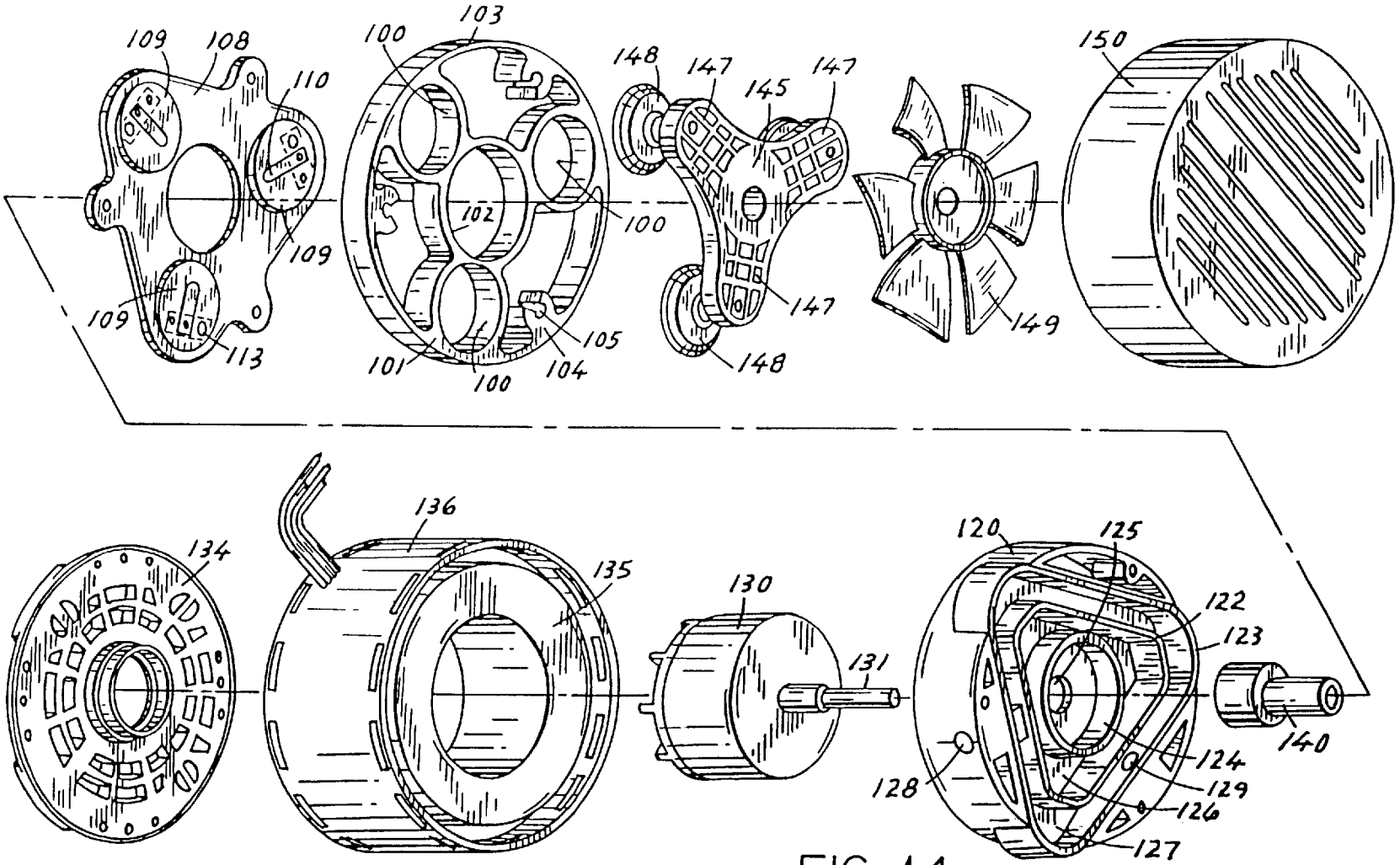
FIG. 14 is an exploded perspective view of yet another embodiment providing a compact, stacked arrangement of elements.
Figure 15:
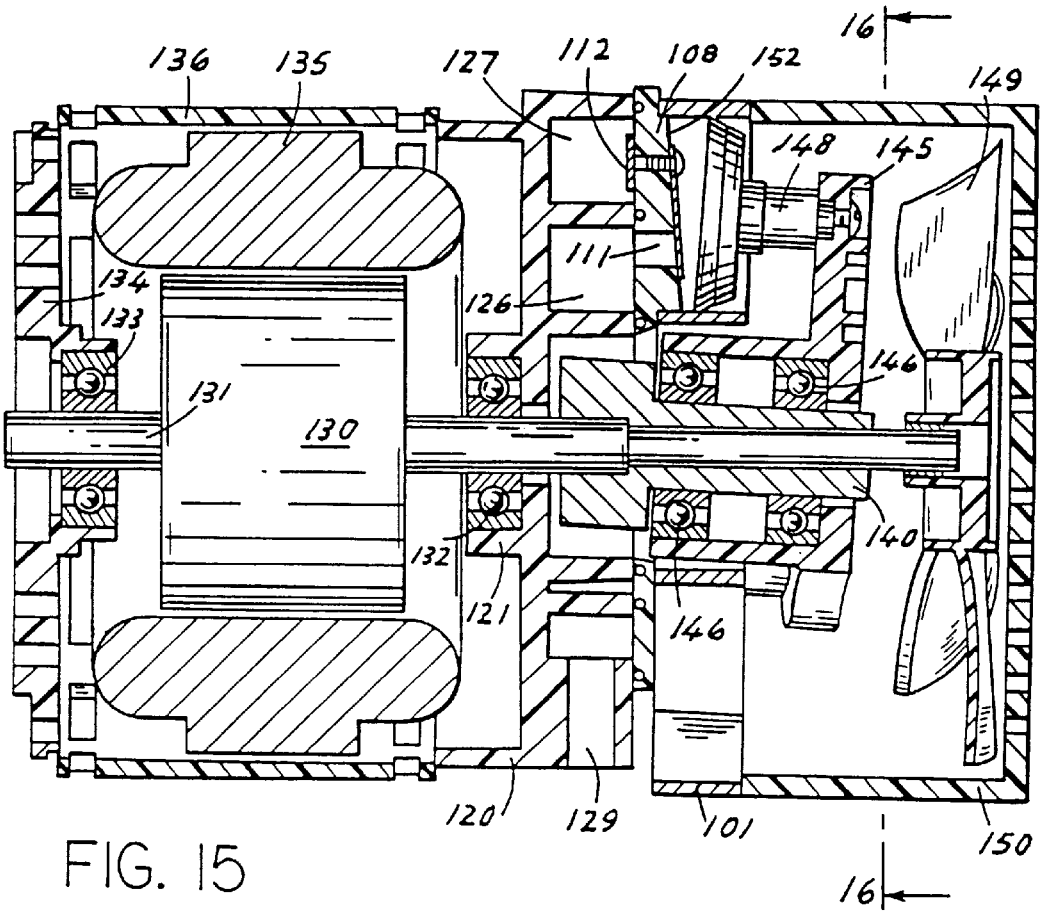
FIG. 15 is a view in longitudinal section of the embodiment of FIG. 14.
Figure 16:
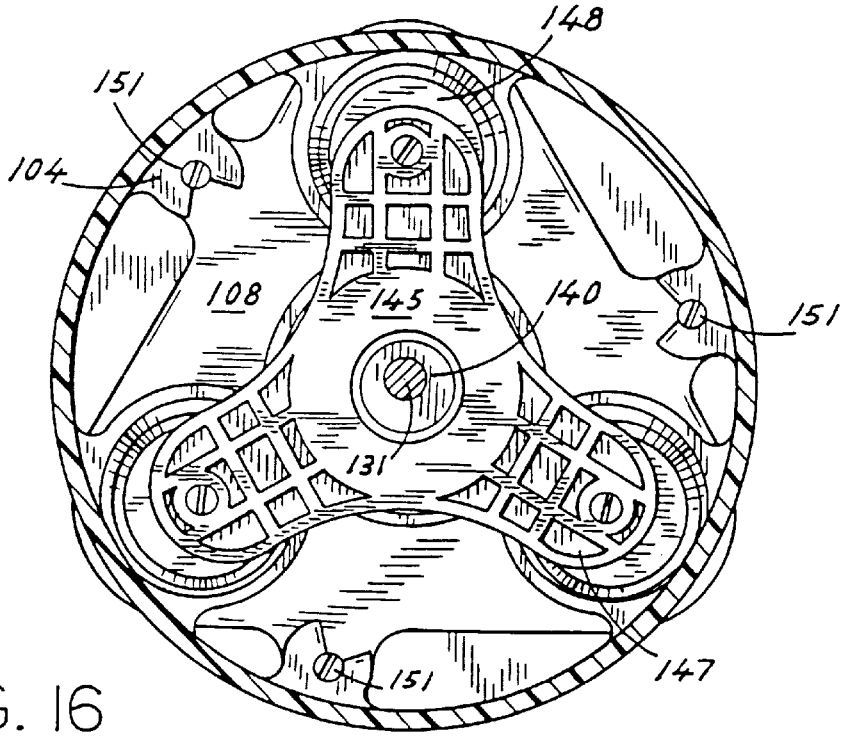
FIG. 16 is a view in elevation, and partially in section, taken in the plane of the line 16—16 of FIG. 15.

The embodiment of FIGS. 14 through 16 is a compact, stacked arrangement with three cylinders arranged symmetrically about a motor shaft axis. The cylinder bores 100 are formed in a extruded aluminum cylinder sleeve 101 which also includes a large central opening 102. The cylinder sleeve 101 has an outer continuous shell 103 from which bosses 104 extend inwardly and include bolt openings 105.

A single valve plate 108, also preferably formed of aluminum, includes three identical valve supports 109 which are received in the three cylinder bores 100. Each valve support 109 mounts an inlet flapper valve 110 that normally closes an inlet opening 111 and exhaust flapper valve 112 that normally closes an exhaust opening 113.

A cast aluminum head 120 has a bearing well 121 on its backside and projecting inner and outer walls 122 and 123, respectively, on its front side. A central circular flange 124 also projects from the front face about a central opening 125. The space between the central flange 124 and the inner wall 122 defines an inlet chamber 126 while the space between the inner and outer walls 122 and 123 defines an exhaust chamber 127. A passageway 128 leads from the exterior of the head 120 to the inlet chamber 126 and another passageway 129 leads from the exterior of the head 120 to the exhaust chamber 127.

The cylinder sleeve 101, valve plate 108 and head 120 are adapted to be stacked together. When stacked, the inlet ports 111 for all three cylinder bores 100 will be in communication with the inlet chamber 126 in the head 120. Similarly, the exhaust ports 113 for all three cylinder bores 100 will be in communication with the exhaust chamber 127 of the head 120. O-ring seals along the edges of the central flange 124 and the inner and outer walls 122 and 123 seal with the flat surfaces of the valve plate 108. Also, O-ring seals surrounding the valve supports 109 seal with the edges of the cylindrical bores 100, as shown in FIG. 15.

A rotor 130 of an electric motor is mounted on a motor shaft 131 which is journaled in a roller bearing 132, held in the bearing well 121 of the head 120, and in a second roller bearing 133 mounted in an end cap 134. A motor stator 135 is disposed about the rotor 130 and a sleeve 136 surrounds the stator. The motor shaft 131 projects through the central openings in the head 120, the valve plate 108 and the cylinder sleeve 101. A hub 140 is mounted on the end of the projecting end of the shaft 131. As with the other embodiments, the hub 140 has its centerline at an acute angle to the axis of the shaft 131. A piston carrier 145 is supported by bearings 146 on the outside of the hub 140. The piston carrier 145 has three symmetrical arms 147 to which are bolted the ends of wobble pistons 148 which are received in the cylinder bores 100.

The motor shaft 131 projects beyond the hub 140 to mount a fan 149. A fan enclosure 150 completes the assembly. The assembly of the end cap 134, sleeve 136, head 120, valve plate 108, and cylinder sleeve 101, is held in place by through bolts 151. The bolts 151 are preferably threaded into threaded openings in the end cap 134. The fan housing 150 may be held in place by radial screws (not shown).

As shown in FIG. 15, the face 152 of each valve support 109 which confronts the head of a wobble piston 148 is inclined so that it is virtually parallel with head of the piston 148 when the piston is at top dead center. This minimizes the clearance volume and results in higher pressures and greater efficiency.

In the embodiment of FIGS. 14–16, the valve plate 108 and cylinder sleeve 102 may be formed as a single member by casting or injection molding. Similarly, the sleeve 136 may be formed integral with the head member 120. Although cast or extruded aluminum is preferred for the cylinder sleeve 101, valve plate 108, and head member 120, other materials may also be used, including filled plastics, steel, and cast iron.

Figure 17:
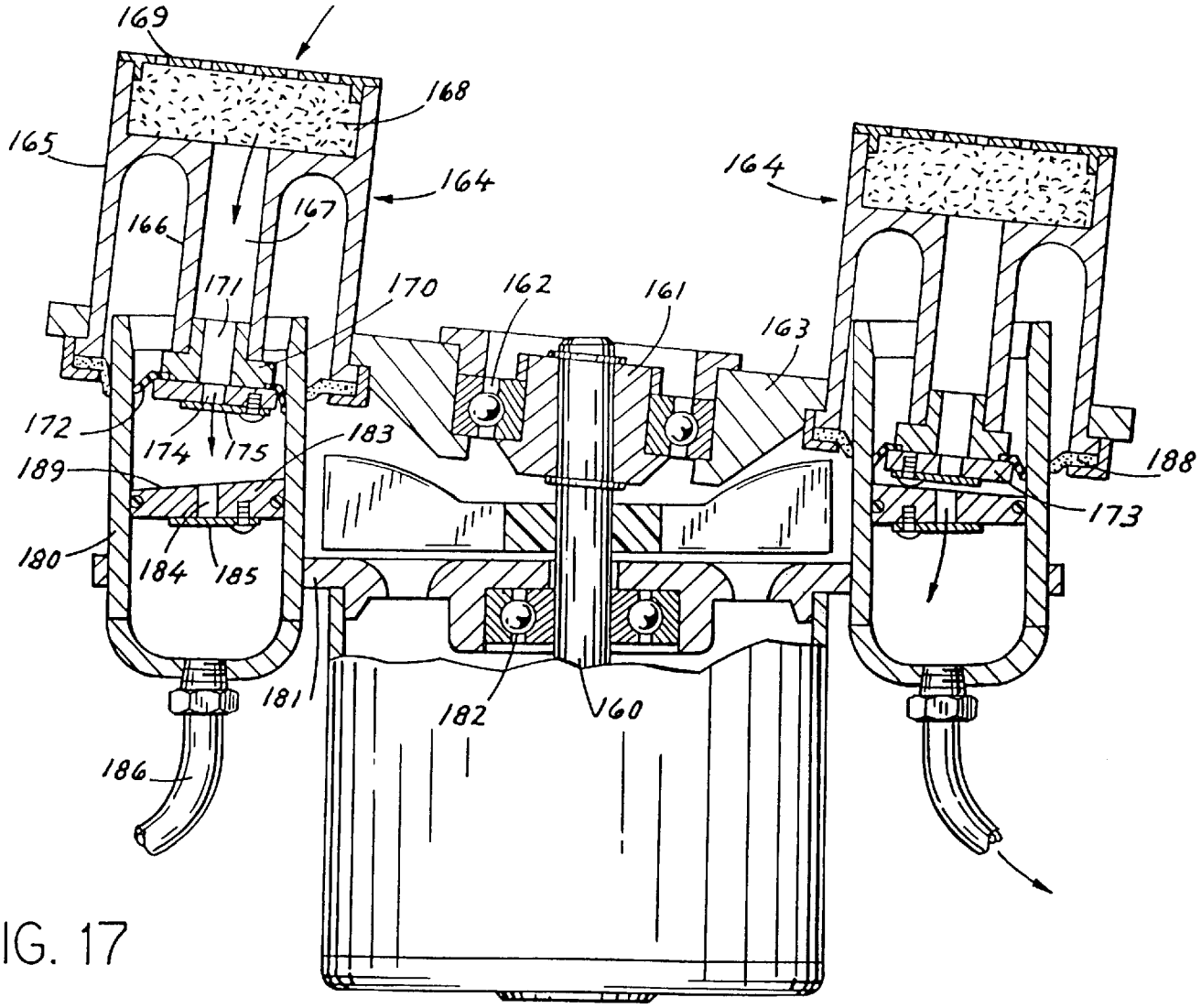
FIG. 17 is a view in section similar to FIG. 3 but showing an embodiment in which the inlet valves are located in the wobble pistons.

In the embodiment of FIG. 17, the inlet valves are formed in the wobble pistons and provision is made to filter incoming air and to seal the apparatus for dirt exclusion and low noise. As in the previous embodiments, a motor shaft 160 mounts a hub 161 whose centerline is at an acute angle to the axis of the shaft 160. The hub 161 mounts a ball bearing 162 which in turn supports a carrier 163. The carrier 163 mounts piston assemblies indicated generally by the reference number 164. The assemblies 164 include an outer cylindrical housing 165, and an integral central piston rod 166 having a central longitudinal passage 167. The end of the passage 167 is protected by filter media 168 and a grill 169 mounted on the outer cylindrical portion 165. A wobble piston head 170 is mounted on the end of the rod portion 166 and includes a central opening 171. A cup type seal 172 is gripped between the piston head 170 and a retainer 173. The retainer 173 has an inlet port 174 which communicates with the opening 171 and passage 167. A flapper valve 175 normally closes the inlet port 174.

Each piston operates in a cylinder 180 supported on a plate 181, which includes a shaft bearing 182. An exhaust valve plate 183 seals with the bore of the cylinder 180. The valve plate 183 includes an exhaust port 184 normally closed by a flapper valve 185. The portion of the cylinder 180 beneath the valve plate 183 comprises an exhaust chamber to which a exhaust tube 186 is connected. The outer cylindrical portion 165 of each piston assembly 164 mounts a radial seal 188 which seals with the exterior of the cylinder 180 as the piston assembly 164 moves in and out of the cylinder 180. The seal 188 may be formed of felt or other material that prevents dirt or other particulates from entering into the interface between the piston and the cylinder.

The face 189 of each valve plate 183 which confronts the piston retainer 173 is inclined to be closely parallel to the surface of the retainer 173 when the piston is at top dead center.

We claim:

1. An axial piston fluid pumping apparatus, comprising:

a drive shaft;

a cylinder having a bore;

a fluid inlet and a fluid outlet communicating with the cylinder bore;

a bearing mounted on the shaft with the centerline of the bearing at an angle to the shaft axis;

an arm mounted on the bearing; and a wobble piston disposed in the bore and rigidly attached to the arm.

2. A fluid pumping apparatus in accordance with claim 1 wherein the bearing is mounted on a hub that is mounted on the shaft with the axis of the hub at an acute angle to the shaft axis so that the hub axis precesses about the shaft axis as the shaft is rotated.

3. A fluid pumping apparatus in accordance with claim 1 wherein the cylinder bore is parallel to the centerline of the bearing.

4. A fluid pumping apparatus in accordance with claim 1 wherein the centerline of the cylinder bore is formed along an arc of a circle having its center at the intersection of the bearing centerline and the shaft axis.

5. A fluid pumping apparatus in accordance with claim 1 wherein the exhaust valve is formed in a valve plate connected to the cylinder bore, the wobble piston has an axial opening leading to the exterior of the apparatus, and the inlet valve is mounted in the piston and communicates with the axial opening.

6. A fluid pumping apparatus in accordance with claim 5 together with a filter disposed in the axial opening.

7. A fluid pumping apparatus, comprising:

a drive shaft;

a plurality of cylinders having bores disposed symmetrically about the axis of the shaft;

fluid inlet and outlet valves communicating with each cylinder bore;

a plurality of symmetrically spaced arms rotatably mounted on a bearing that is mounted on a hub connected to the shaft with the axis of the hub at an acute angle to the shaft axis so that the hub axis precesses about the shaft axis as the shaft is rotated; and a wobble piston rigidly attached to each arm and disposed in and sealed with a respective cylinder bore.

8. A fluid pumping apparatus in accordance with claim 7 wherein the center of gravity of the arms, pistons, and bearing is at the intersection of the axis of the hub with the shaft axis.

9. An axial piston fluid pumping apparatus, comprising:

a drive shaft;

a cylinder having a bore spaced from the shaft;

fluid inlet and outlet valves connected to the cylinder;

a piston having a head with a peripheral seal disposed in and sealing with the cylinder bore;

a hub disposed on the shaft with its axis at an angle to the axis of the shaft so that the hub axis precesses about the axis of the shaft; and an arm rotatably mounted on the hub and extending laterally to the shaft axis, said arm rigidly mounting the piston, whereby the piston head will be moved in three dimensions in the cylinder bore as the shaft is rotated.

10. A fluid pumping apparatus in accordance with claim 9 wherein the cylinder bore is parallel with the hub axis.

11. A fluid pumping apparatus in accordance with claim 9 wherein the centerline of the cylinder bore is formed along an arc of a circle having its center at the intersection of the axes of the hub and the shaft.

* * * * *